US012414632B2

(12) United States Patent
Spong

(10) Patent No.: US 12,414,632 B2
(45) Date of Patent: Sep. 16, 2025

(54) CONVERTIBLE CHAIR

(71) Applicant: RUNNERFLY LTD, East Cowes (GB)

(72) Inventor: Steven Richard Spong, East Cowes (GB)

( * ) Notice: Subject to any disclaimer, the term of this patent is extended or adjusted under 35 U.S.C. 154(b) by 227 days.

(21) Appl. No.: 18/257,289

(22) PCT Filed: Dec. 17, 2021

(86) PCT No.: PCT/GB2021/053355

§ 371 (c)(1),
(2) Date: Jun. 13, 2023

(87) PCT Pub. No.: WO2022/129939

PCT Pub. Date: Jun. 23, 2022

(65) Prior Publication Data

US 2024/0041215 A1 Feb. 8, 2024

(30) Foreign Application Priority Data

Dec. 17, 2020 (GB) ..... 2020056

(51) Int. Cl.

| | |
|---|---|
| ***A47C 9/00*** | (2006.01) |
| ***A47C 1/032*** | (2006.01) |
| ***A47C 3/20*** | (2006.01) |
| ***A47C 7/50*** | (2006.01) |

(Continued)

(52) U.S. Cl.

CPC ..... *A47C 7/5068* (2018.08); *A47C 1/03255* (2013.01); *A47C 3/20* (2013.01);

(Continued)

(58) Field of Classification Search

CPC ..... A47C 9/005

(Continued)

(56) References Cited

U.S. PATENT DOCUMENTS 4,736,982 A * 4/1988 Hwang ..... A47C 9/005 297/423.13 X
4,793,655 A * 12/1988 Kvalheim ..... A47C 9/005 297/423.13 X (Continued)

FOREIGN PATENT DOCUMENTS

DE 9114238 U1 1/1992
JP 01175809 A * 7/1989 ..... A47C 9/005

(Continued)

*Primary Examiner* — Rodney B White
(74) *Attorney, Agent, or Firm* — NEXUS LAW PLLC

(57) ABSTRACT

A convertible chair adapted for conversion between a sitting configuration and a kneeling configuration includes_a base support, a knee-back rest movably coupled to the base support by a pivot arm, a seat movably coupled to the base support by a coupling mechanism, and a connecting arm linking the pivot arm and the seat. The seat is arranged to move relative to the base support between a first seat position corresponding to the sitting configuration and a second seat position corresponding to the kneeling configuration. The pivot arm is arranged to pivot relative to the base support between a first pivot arm position in which the knee-back rest is in a first knee-back rest position for use as a back rest and a second pivot arm position in which the knee-back rest is in a second knee-back rest position for use as a knee rest.

16 Claims, 7 Drawing Sheets

(51) Int. Cl.

| | |
|---|---|
| ***A47C 9/02*** | (2006.01) |
| *A47C 7/00* | (2006.01) |
| *A47C 7/40* | (2006.01) |
| *A47C 7/54* | (2006.01) |

(52) U.S. Cl.
CPC ..... *A47C 9/005* (2013.01); *A47C 7/004* (2013.01); *A47C 7/006* (2013.01); *A47C 7/40* (2013.01); *A47C 7/54* (2013.01)

(58) Field of Classification Search
USPC ..... 248/188.7
See application file for complete search history.

(56) References Cited

U.S. PATENT DOCUMENTS

| | | | | | |
|---|---|---|---|---|---|
| 5,054,857 | A * | 10/1991 | Kvalheim | ..... | A47C 13/00 297/423.13 X |
| 5,261,727 | A * | 11/1993 | Klaebel | ..... | A47C 9/005 297/423.13 X |
| 8,313,067 | B2 * | 11/2012 | Knieriem | ..... | F16M 11/42 248/188.7 |
| 2008/0203803 | A1 * | 8/2008 | Chi | ..... | A47C 9/005 297/411.37 |

FOREIGN PATENT DOCUMENTS

| | | | | | |
|---|---|---|---|---|---|
| TW | M243111 | U | 9/2024 | | |
| WO | WO-8804903 | A1 * | 7/1988 | ..... | A47C 9/005 |
| WO | WO 91/10384 | A1 | 7/1991 | | |
| WO | WO-9221270 | A1 * | 12/1992 | ..... | A47C 1/027 |
| WO | WO-9309701 | A1 * | 5/1993 | ..... | A47C 13/00 |

* cited by examiner

CONVERTIBLE CHAIR

CROSS REFERENCE TO RELATED APPLICATIONS

The present application claims the priority benefits of International Patent Application No. PCT/GB2021/053355, filed on Dec. 17, 2021, and claims benefit of GB 2020056.4, filed on Dec. 17, 2020, which are hereby incorporated herein by reference in their entireties.

FIELD OF THE INVENTION

The present invention relates to a convertible chair, specifically to a chair adapted for conversion between a sitting configuration and a kneeling configuration.

BACKGROUND OF THE INVENTION

Conventional chairs utilising a seat and backrest are well known in which the user sits in a conventional upright sitting position. It is also known to provide a backless chair that allows the user to 'sit' in a kneeling position in which their knees or shins are supported. This may provide extra comfort to the user by improving their posture.

The combination of these two seated positions, made allowable by a transformation of a chair's supporting structure, is a more recent idea. There have been previous attempts to provide this feature by changing the relative positions of the seat and back rest cushions so that they can fulfil the function of both back and knee rest when the chair is converted between conventional sitting use and kneeling use.

U.S. Pat. No. 5,054,857 discloses a chair which is convertible by mounting the back rest on a pivoted arm and providing for swivelling the arm to put the backrest into a knee rest position. Essential independent movement and adjustment of the seat and knee-back rest is then catered for by use of various adjustment knobs which position the knee-back rest and seat in the correct position for comfortable use. The mechanisms detailed in U.S. Pat. No. 5,054,857 are particularly complex, requiring a large number of components. In addition, the conversion from a comfortable upright seated position to a comfortable sit-kneel position requires numerous operations resulting in the conversion being a lengthy process and ultimately an inconvenience for the user. The chair's centre of gravity and pivot/swivel point is located to the rear of the user, when in the upright seated position, reducing the ergonomic convenience of this function and resulting in the footprint/base of the chair being larger than that of conventional chairs.

U.S. Pat. No. 4,736,982 discloses a convertible chair comprising a base support in which the seat is pivotally connected to the base support and back-knee rest that is also pivotally connected to the base support. The conversion from an upright seated position to a sit-kneel position requires manual adjustment of the mechanism to remove and re-insert a locking pin. Moreover, the user's centre of gravity is altered in relation to the base of the chair when transferring from upright seated position to sit-kneel position. This results in the 'footprint'/base of the chair to be larger than that of its counterparts and protruding from the rear of the user when in upright position in order that the chair remains stable when converted and in the sit-kneel configuration.

It is an object of the invention to address one or more of the above mentioned problems.

SUMMARY OF THE INVENTION

In accordance with a first aspect there is provided a convertible chair adapted for conversion between a sitting configuration and a kneeling configuration, the chair comprising any one or more of the following features:

a base support;

a knee-back rest movably coupled to the base support by a pivot arm, the pivot arm arranged to pivot relative to the base support between a first pivot arm position in which the knee-back rest is in a first knee-back rest position corresponding to the sitting configuration in which the knee-back rest is positioned for use as a back rest and a second pivot arm position in which the knee-back rest is in a second knee-back rest position corresponding to the kneeling configuration in which the knee-back rest is positioned for use as a knee rest;

a seat movably coupled to the base support by a coupling mechanism, whereby the seat is arranged to move relative to the base support between a first seat position corresponding to the sitting configuration and a second seat position corresponding to the kneeling configuration;

a connecting arm linking the pivot arm and the seat, the connecting arm having a first end pivotally coupled relative to the seat and a second end pivotally coupled to the pivot arm whereby the seat and knee-back rest are operably linked to each other, wherein:

the coupling mechanism comprises a releasable catch arranged to couple the pivot arm and the seat when in the first seat position and the first pivot arm position, thereby restricting pivotal movement of the pivot arm relative to the base support, the releasable catch arranged to release by pivotal movement of the seat away from the first seat position; and the coupling mechanism further comprises a control mechanism arranged to control and restrict the range of movement of the seat relative to the base support between the first seat position and the second seat position when the releasable catch is released.

The convertible chair is therefore provided with a releasable catch that is arranged to release from engagement between the pivot arm and seat by rotational movement of the seat. This allows it to be easily converted between the sitting and kneeling configurations, but also cannot be accidently converted while the user is sat on the chair. When sat on the chair in the sitting configuration the user's weight acting against the seat prevents the releasable catch from being disengaged without them first standing up. This makes the user feel secure in the sitting configuration of the chair because it cannot easily be converted accidently. Once the user has stood up from the chair it can be converted easily without needing to operate a complex mechanism.

The combination of the releasable catch, connecting arm and control mechanism to control and restrict movement may provide a convertible chair that is quick and easy to change configuration using a single one-handed motion from the user.

The chair may be converted from the sitting configuration to the kneeling configuration using only the releasable catch, with no other input required from the user to manually move parts of the chair between different positions. Similarly, motion from the kneeling configuration to the sitting configuration may be achieved by the user moving only one of the knee-back rest or seat, with the movement of the other guided and controlled by the connecting arm and control mechanism. This simple operation is advantageous over known convertible chairs which have complex conversion mechanisms requiring multiple operations from the user. Such known seats typically include further adjustment controls to fine tune the ergonomics in the kneeler configuration. Contrary to this, the chair of the present application can allow a single operation to quickly and simply convert the chair.

The releasable catch may be arranged to release by pivotal movement of the seat away from the first seat position in which an edge of the seat furthest from the knee-back rest moves in a vertical direction of the chair. This further helps ensure the releasable catch cannot be disengaged accidently as the user cannot lift the front of the seat while sat down in such in such a way as to release the catch without first lifting their weight off the seat.

The edge of the seat furthest from the knee-back rest may be the front edge of the seat, and the seat may further comprise a back edge opposite the front edge, the back edge being relatively closer to the knee-back rest when the chair is in the sitting configuration. The seat may be arranged to pivot relative to the base support at a seat pivot point (pivot point B). The seat pivot point may be located closer to the back edge of the seat compared to the front edge when the seat is in the first seat position and the chair in the sitting configuration. This makes it more difficult to pivot the seat from the first seat position when the user is sitting on the seat.

The seat pivot point may be located between the back edge and a quarter-way point located a distance corresponding to a quarter of the distance from the back edge to the front edge along the axis extending between them (when the seat is in the first seat position and the chair in the sitting configuration). This further ensures the seat is difficult to pivot while being sat on and inadvertently release the catch.

The releasable catch may comprise a hooked member coupled to one of the seat and the pivot arm, the hooked member may be arranged to releasably engage with a pin provided on the other of the seat and the pivot arm.

The seat may be arranged to translate and pivot (i.e., rotate) relative to the base support between the first seat position and the second set position.

The combined translational and rotational/pivotal movement of the seat allows the seat to move from a position in which the user can sit on it to a position suitable for kneeling on the chair. The translational movement of the seat relative to the base support allows the user's centre of gravity to remain in the same position relative to the base support between the two chair configurations. The movement of the seat in this way allows the user's centre of mass to be accommodated between the two different uses of the chair. This helps to make the chair more stable, and means that the chair can be made with a base support having a smaller footprint without the chair becoming unstable.

The seat may be arranged to translate in a direction away from the location of the knee-back rest in the knee-back rest first position when the seat moves from the first seat position to the second seat position. The seat therefore translates in a forward direction of the chair in its sitting configuration, i.e., so that it is moved further away from the knee-back rest. This allows the centre of gravity to be moved to a more suitable position in the kneeling configuration of the chair.

The control mechanism (of the coupling mechanism) may comprise a guide track connected to one of the seat or the base support and a guide pin connected to the other of the seat and the base support. The guide pin may be received in the guide track to control movement of the seat between the first and second seat positions.

The guide track may comprise an arcuate portion arranged to guide rotational movement of the seat and a linear portion arranged to guide translational movement of the seat.

The control mechanism (of the coupling mechanism) may comprise a cam mechanism (or crank mechanism) having a cam (or crank) member connected between the seat and the base support. The cam member may be arranged control rotational and translational movement of the seat between the first and second seat positions.

The second end of the connecting arm max be pivotally coupled to the pivot arm at a point between the base support and the back-knee rest.

The convertible chair may further comprise a suspension mechanism arranged to provide a flexible coupling between the seat and/or the knee-back rest and the base member. The suspension mechanism may be arranged to have a greater degree of flexibility in the sitting configuration of the chair compared to the kneeling configuration of the chair.

The suspension mechanism may comprise a flexure member that forms at least part of the connection between the seat and the base support. (and/or the knee-back rest and the base support), wherein a sliding coupling of the coupling mechanism is arranged to change an unsupported length of the flexure member between the sitting and kneeling configurations of the chair thereby changing the degree of flexibility of the suspension mechanism.

The coupling mechanism may further comprise an adjuster arranged to independently adjust the unsupported length of the suspension member. The adjuster may be arranged to change the flexibility of the suspension member independently of the sliding coupling of the coupling mechanism.

The base support may comprise a plurality of radially extending legs. At least one of the legs may comprise a distal wheel portion having a wheel or caster connected thereto on which the chair is arranged to rest on the ground or other surface, and a proximally located connection portion. The height of a top surface of the connection portion from the ground or other surface may be less that the height of a top surface of the wheel portion from the ground or other surface to form a cut-out region of the respective leg. This provides the user with additional space around the extending legs for their feet.

The plurality of legs may comprise five or fewer legs. This may also provide further space for the user's feet. The plurality of legs may comprise four or fewer legs. This may provide vet further space for the user's feet.

The convertible chair may further comprise a damping system arranged to control movement between the sitting and kneeling configurations. The damping system may comprise a damper arranged to control sliding movement of the coupling mechanism.

The convertible chair may further comprise a (secondary) locking mechanism. The locking mechanism may have a locked configuration in which the coupling mechanism is locked to prevent movement between the sitting and kneeling configurations of the chair.

The base support may comprise a vertically extending base stern. The pivot arm may be pivotally connected to an upper region of the base stem.

The convertible chair may further comprise one or more arm rests coupled to the seat or the coupling mechanism.

In accordance with a second aspect there is provided a convertible chair adapted for conversion between a sitting configuration and a kneeling configuration, the chair comprising:

a base support;

a knee-back rest movably coupled to the base support by a pivot arm, the pivot arm arranged to pivot relative to the base support between a first pivot arm position in which the knee-back rest is in a first knee-back rest position corresponding to the sitting configuration in which the knee-back rest is positioned for use as a back rest and a second pivot arm position in which the knee-back rest is in a second knee-back rest position corresponding to the kneeling configuration in which the knee-back rest is positioned for use as a knee rest; and a seat movably coupled to the base support by a coupling mechanism, whereby the seat is arranged to move relative to the base support between a first seat position corresponding to the sitting configuration and a second seat position corresponding to the kneeling configuration, wherein:

the seat is arranged to translate and pivot (i.e., rotate) relative to the base support between the first seat position and the second set position.

The skilled person will appreciate that, except where mutually exclusive, a feature described in relation to any one of the above aspects may be applied to any other aspect. The statements following the first aspect may therefore apply to the second aspect, unless where mutually exclusive.

These and other objects, advantages and features of the invention will become apparent upon review of the following specification in conjunction with the drawings.

BRIEF DESCRIPTION OF THE DRAWINGS

Embodiments of the invention will now be described, by way of example only, with reference to the accompanying drawings, in which.

DESCRIPTION OF THE PREFERRED EMBODIMENTS

Figure 1:
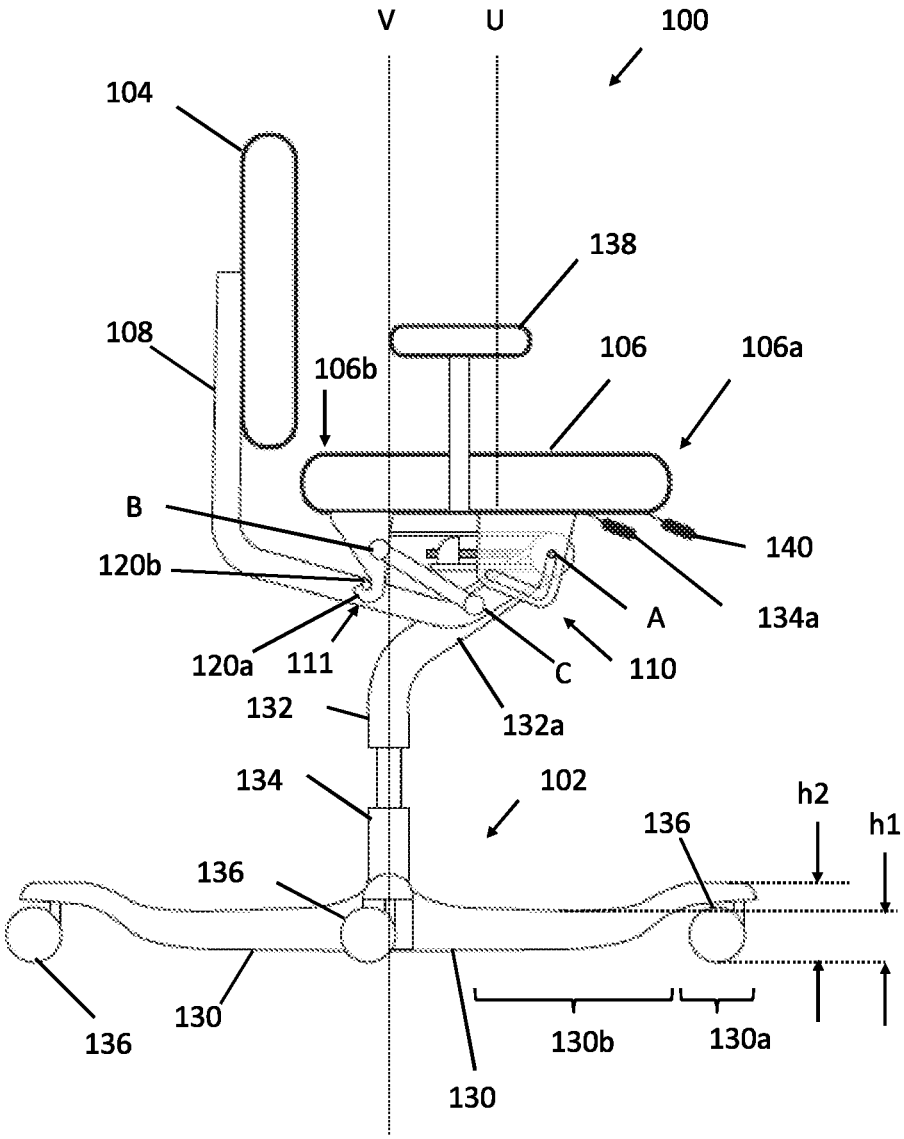
FIG. 1 is a side elevational view of a first embodiment of a convertible chair in a conventional upright seated configuration.
Figure 2:
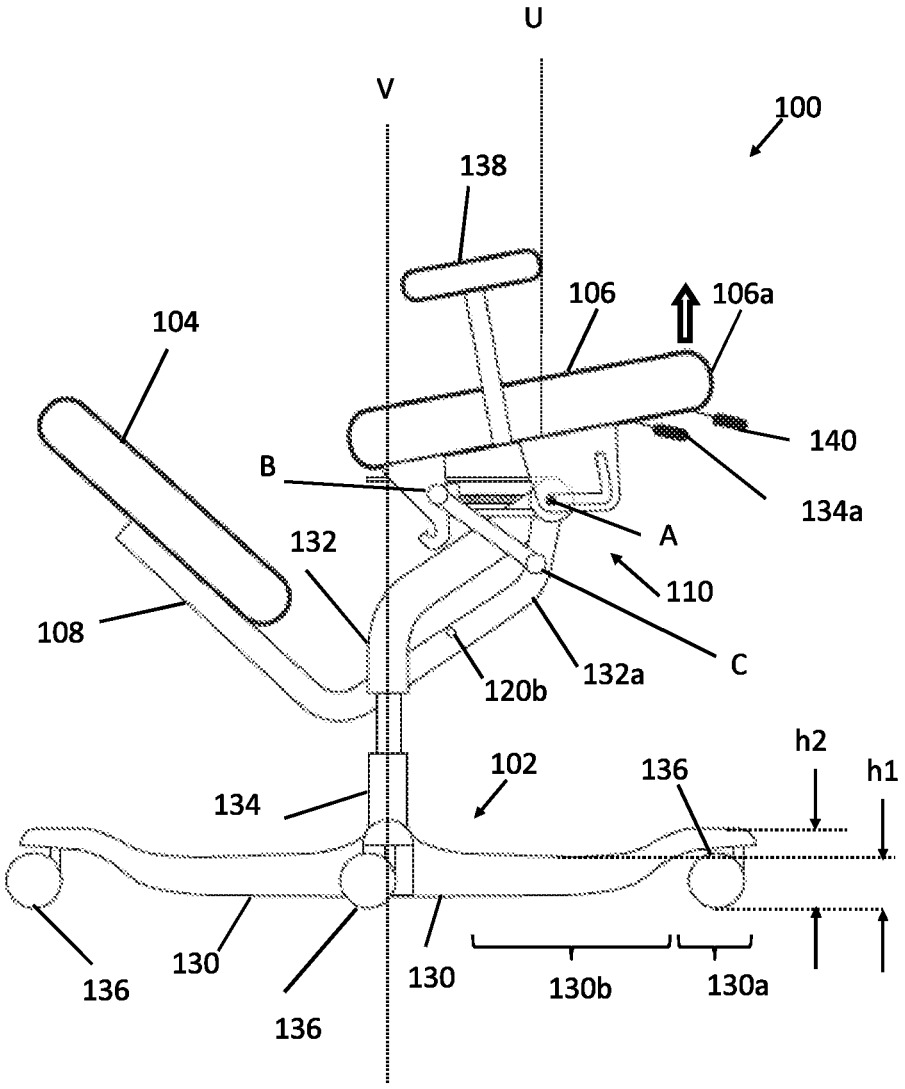
FIG. 2 is a side elevational view of the first embodiment in kneeling configuration.

FIGS. 1 and 2 illustrate an exemplary convertible chair 100, which generally comprises a base support 102, a knee-back rest 104 and a seat 106. The base support is arranged to support both the knee-back rest and the seat above the ground. The chair 100 is configured to convert between a 'sitting' configuration in which it can be sat on in a conventional manner, and a 'kneeling' configuration in which it is configured for the user to sit-kneel on with the knees/shins supported. The greyed-out lines in the figures show components behind another component.

FIG. 1 shows the chair in the sitting configuration, with the knee-back rest 104 in a first knee-back rest position in which it is positioned for use as a back rest. The seat 106 is in a corresponding first seat position for use as conventional seat. The chair is configured in a conventional upright manner with the seat 106 in a generally horizontal orientation and the knee-back rest 104 in a generally vertical orientation located above and offset relative to the seat 106. In this position the user would sit in the chair in a conventional manner with thighs/buttocks on the seat 106 and back resting on knee-back rest 104 (facing to the right in the figures).

FIG. 2 shows the chair 100 in the 'kneeling' configuration. In this configuration, the knee-back rest 104 is in a second knee-back rest position in which it is posited for use as a knee rest. The seat 106 is in a corresponding second seat position for use as a 'kneeling' seat. In this configuration the seat 106 is in a more angled orientation relative to horizontal. The knee-back 104 is positioned below the level of the seat and is in an angled position relative to vertical. In this configuration the user would 'sit-kneel' on the chair 100 with thighs/buttocks rested on the angled seat 106 and the knees/calves/shins rested on the angled knee-back rest 104 (facing to the left in the figures).

Figure 6:
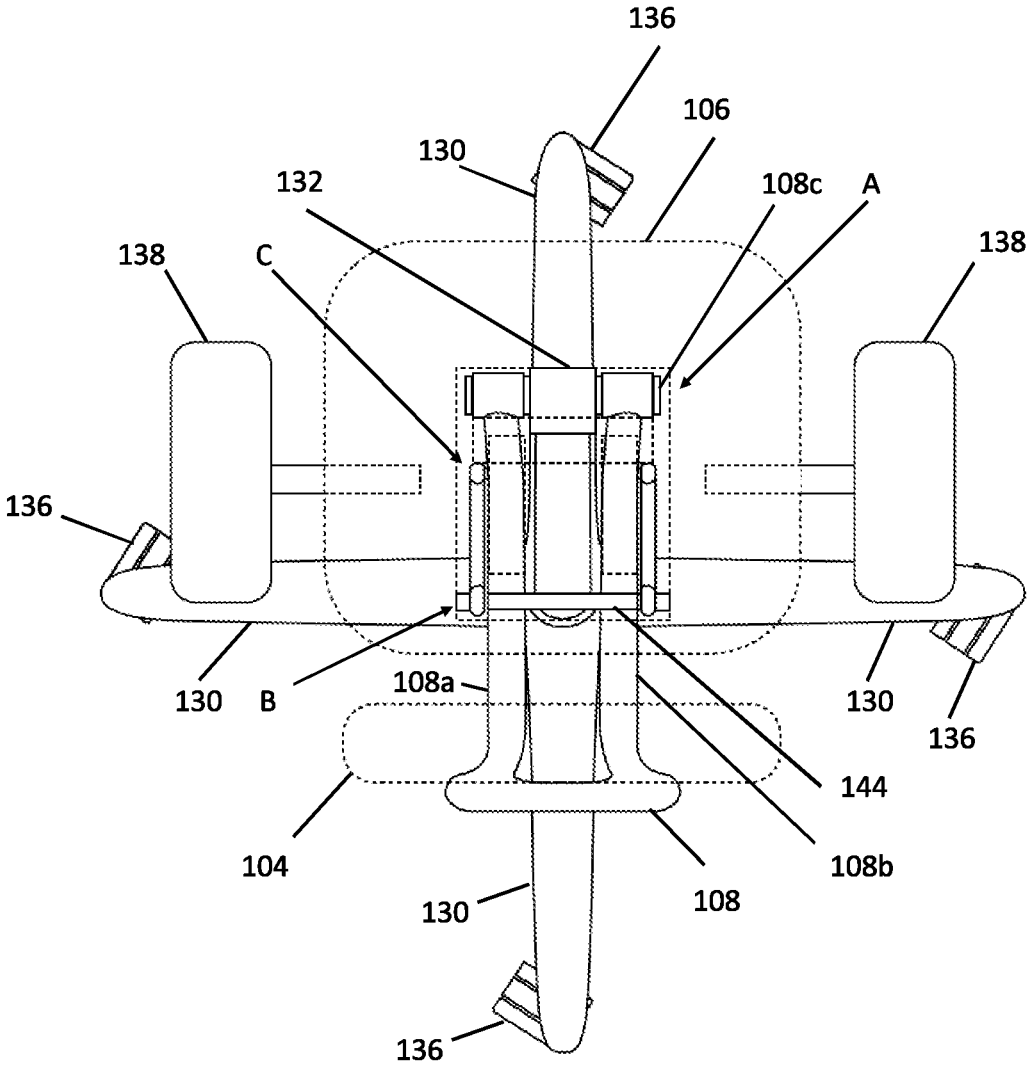
FIG. 6 is a cut-away top elevation view of the convertible chair according to another embodiment.

In order to move between the first and second positions the knee-back rest 104 is pivotally coupled to the base support 102 by a pivot arm 108. The pivot arm is coupled to the base support such that is pivots about pivot point 'A' (the pivot arm pivot point) shown in the figures. This may be done by a connecting shaft as shown in FIG. 6. The pivot arm 108 is generally arcuate or angled in shape, and connects to the base support 102 below the seat 106. The pivot arm 108 extends out from under the seat 106, with the knee-back rest 104 connected to its distal end. The pivot arm 108 moves between a first pivot arm position in which the knee-back rest 104 is in the first knee back rest position and the chair is in the sitting configuration, and a second pivot arm position in which the knee-back rest 104 is in the second knee-back rest position and the chair is in the kneeling configuration.

Any reference to a pivot point herein may correspond to a pivot axis about which one or more components may pivot or rotate as described herein. The pivot points A, B and C described herein may therefore alternatively be referred to as pivot axes A, B, and C.

The chair 100 further comprises a coupling mechanism 110 arranged to movably couple the seat 106 to the base support 102. This allows the seat 106 to move relative to the base support 102 between the first seat position and the second seat position.

The coupling mechanism 110 comprises a releasable catch 111 (i.e., a safety catch). The releasable catch 111 is arranged to couple the pivot arm 108 and the seat 106 when they are in their respective first positions so that the pivot arm 108 cannot pivot away from the first pivot arm position. This secures the chair 100 in the sitting configuration when the releasable catch 111 is engaged. The releasable catch 111 is releasable so that the pivot arm 108 and the seat 106 can move relative to each other when the releasable catch 111 is disengaged.

The releasable catch 111 is released by pivotal (e.g., rotational) movement of the seat 106 away from the first seat position. In order to release the releaseable catch 111 from engagement between the pivot arm 108 and the seat 106, the edge of the seat **106*a* furthest from the knee-back rest 104 is moved in vertical direction of the chair (e.g., rotation in an anti-clock wise direction about pivot point B in the figures as indicated by the arrow in FIG. 2). When the user is sitting on the seat their weight (and the weight of the seat) will act against the rotation of the seat 106 required to release the releasable catch 111. This ensures that the chair cannot be converted when being sat on by inadvertently disengaging the releasable catch 111**.

By vertical direction of the chair, we mean in a direction away from the part of the base support 102 on which the chair is configured to rest (i.e., the bottom of the base support), parallel to a longitudinal axis of the chair (i.e., an axis that is vertical when the chair is in use and resting on a horizontal surface, e.g., axis V in FIG. 1).

The releasable catch 111 comprises a hooked member 120*a* fixed relative to the seat 106 (e.g., fixed to part of the seat or a component rigidly connected to the seat). The hooked member 120*a* is arranged to releasably engage with a pin 120*b* provided on the pivot arm 108. In other embodiments, the pin and hooked member may be reversed so that the hook is provided on the pivot arm and the pin on the seat.

Figure 7:
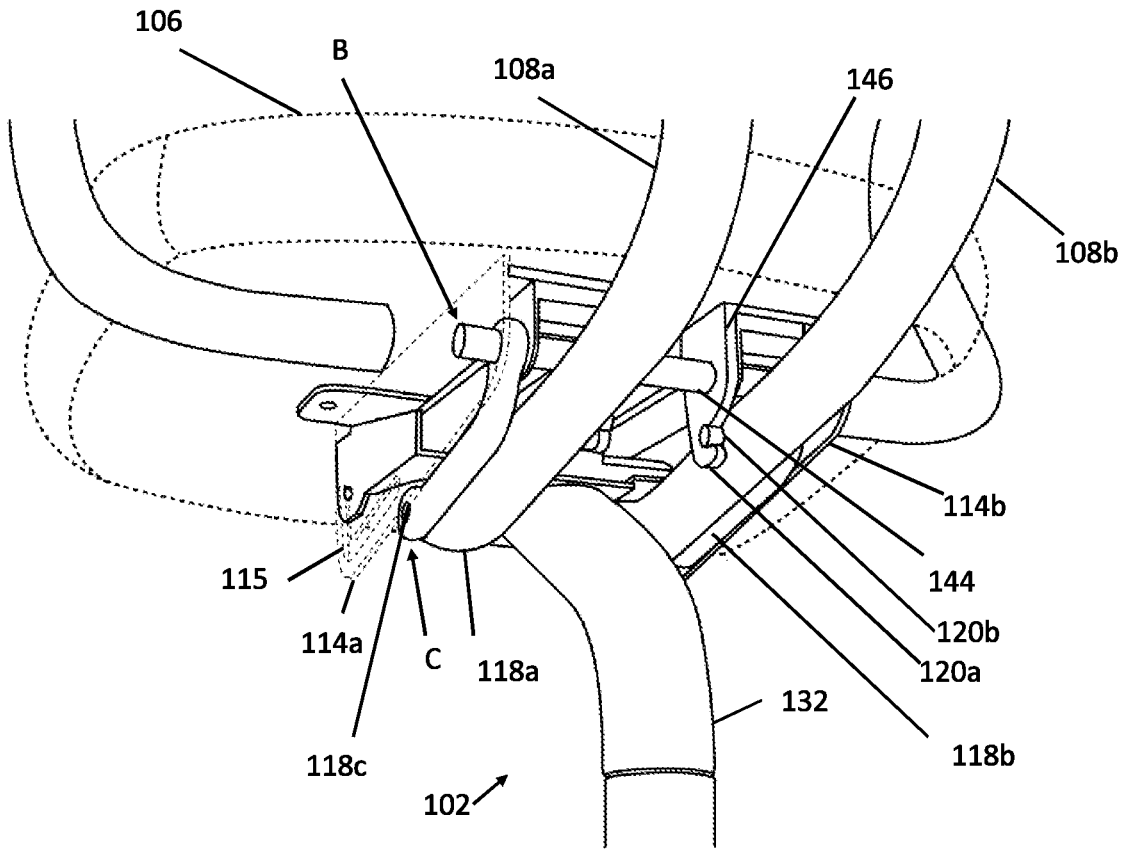
FIG. 7 shows a close-up view of the releasable catch and pivot arm of the embodiment shown in FIG. 6.

The coupling mechanism is arranged to pivotally couple the seat 106 to the base support 102 at pivot point B shown in FIG. 1. This may be done by a coupling shaft as shown in FIGS. 6 and 7. Pivotal movement around pivot point B allows the seat to move between the sitting and kneeling configurations of the chair. In order to further help ensure the releasable catch 111 cannot be released by movement of the seat 106 as described above, pivot point B is located at a position closer to the back edge 106*b* of the seat (the back edge being opposite the front edge 106*a*, closest to the back-knee rest 104) compared to the front edge 106*a*. As can be seen in FIG. 1, pivot point B is located level with a point on the underside of the seat 106 that is closer to the back edge 106*b* than the front edge 106*a* (e.g., between the back edge 106*b* and a half-way point along an axis extending between the back edge 106*b* and the front edge 106*a*). This makes the seat 106 difficult to pivot about pivot point B while the user is sat on the chair 100. In the described embodiment, the pivot point B is located between the back edge 106*b* and a quarter-way point located a distance corresponding to a quarter of the distance from the back edge 106*b* to the front edge 106*a* along the axis extending between them. This further ensures the seat is difficult to pivot while being sat on. The positions of the pivot point B described in this paragraph are when the chair is in the sitting configuration (i.e., the first position of the seat 106).

In the presently described embodiment, the coupling mechanism 110 is arranged to provide both a sliding and a pivotal connection of the seat 106 to the base support 102. This allows the seat 106 to move in both a rotational and translational manner between the first and second seat positions (i.e., between the sitting and kneeling configurations of the chair). The rotational movement allows the seat 106 to be angled relative to the more horizontal first position so that it is more suitably positioned to support the user's legs/buttocks in a kneeling posture. The translational movement of the seat allows the user's center of gravity to remain in an approximately constant position (or at least closer to the same position compared to without the translation of the seat) relative to the base support between the two chair configurations, despite the change in the user's orientation and posture. The movement of the seat in this way allows the user's center of mass to be accommodated between the two different uses of the chair. This helps to make the chair more stable, and means that the chair can be made with a base support having a smaller footprint without the chair becoming unstable. In other embodiments, only a pivotal coupling may be provided by the coupling mechanism 110.

The seat 106 is arranged to translate in a direction away from the knee-back rest first position (e.g., as shown in FIG. 1) when moving from the first seat position and to the second seat position. The seat is arranged to translate such that a vertical centre axis U of the seat 106 moves with respect to a vertical centre axis (or longitudinal axis) V of the base support. The seat translates such that axis U moves further from the axis V when moving from the sitting to the kneeling configurations of the chair. This allows the user's centre of gravity to be kept in a similar position with respect to the base support 102.

Figure 3:
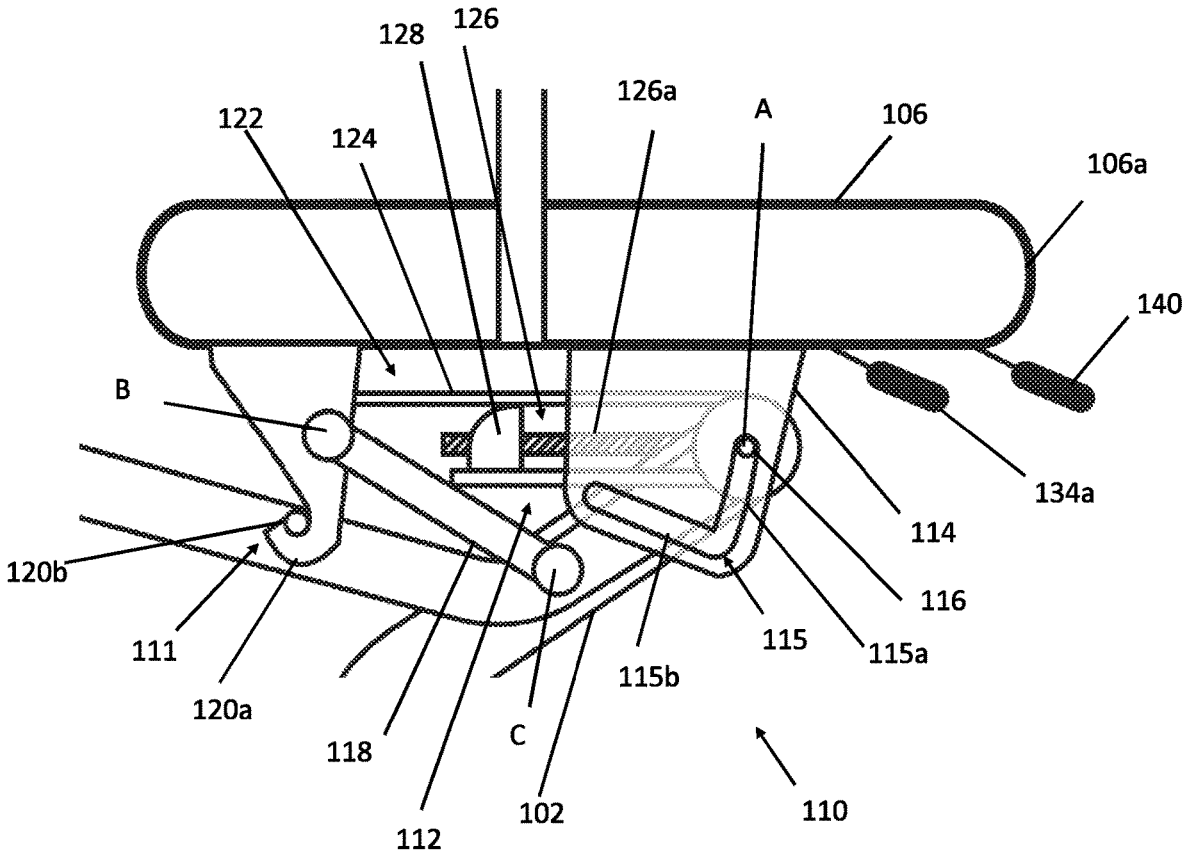
FIG. 3 shows a close-up view of part of FIG. 1.

The coupling mechanism 110 is shown in more detail in FIG. 3. The coupling mechanism 110 comprises a fixed slider support 112 that is rigidly coupled to or forms part of the base support 102. The slider support 112 extends below the seat 106 and provides a relatively fixed structure to which the seat 106 is both slidably and pivotally coupled. Pivot arm 108 is also coupled to the fixed slider support at pivot point A as shown in Figures.

In the present embodiment, the seat 106 is connected to the fixed slider support at sliding pivot point 'B' (the seat pivot point). The coupling mechanism 110 is arranged such that this connection point rotates and translates relative to the fixed slider support 112. This may be achieved using any suitable arrangement of bearings or the like as would be understood by the skilled person. In the present embodiment, a single pivoting/sliding point of connection is provided. In other embodiments, the coupling mechanism may have separate pivot and sliding connections.

The coupling mechanism 110 further comprises a control mechanism arranged to control the rotational and translation movement of the seat 106 relative to the base support 102. The control mechanism comprises a guide member 114 which has a guide track 115 as can be seen in FIG. 3. The guide track 115 is formed from a slot in a plate forming the guide member 114. The plate extends from the underside of the seat 106. The guide track 115 engages with a guide pin 116 that is fixed relative to the base support 102. The guide pin 116 is slidably received in the guide track 115 to control movement of the seat 106 between its first and second seat positions. In the present embodiment, the guide pin 116 is aligned with pivot point A about which the pivot arm 108 is arranged to pivot. In other embodiments, the guide pin 116 may be located at any other suitable point on the base support 102 or relatively fixed part of the coupling mechanism (e.g., the fixed slider support) such that the pin is fixed relative to the base support 102. In yet other embodiments, the guide pin 116 is provided on the seat 106, with the guide member 114 mounted on the base support/fixed slider support.

The guide track 115 comprises an arcuate portion 115*a* arranged to guide rotational movement of the seat 106 and a linear portion 115*b* arranged to guide translational movement of the seat 106. By forcing the guide pin 116 to follow the path created by the separate sections of the guide track 115 the seat 106 is arranged to have separate sliding and pivotal motions when converting the chair between the sitting and kneeling configurations. The range of motion of the pin 116 within the guide track 115 is configured to restrict the range of motion of the seat 106 relative to the base support 102. The guide pin 116 abuts one end of the guide track 115 in the sitting configuration of the chair, and the other end of the guide track 115 in the sit-kneeling configuration of the chair as can be seen in FIGS. 1 and 2 to limit the range of movement.

In the present embodiment, the coupling mechanism 110 is operably coupled to the pivot arm 110. The means that the seat 106 and knee-backrest are operably linked to each other. Movement of the seat or knee-back rest between the respective first and second positions therefore drives movement of the other of the seat or knee-back rest between the respective first and second positions. The operable coupling is provided by a connecting arm 118 linking the pivot arm 108 and the seat 106 (e.g., a part of the coupling mechanism that is fixed relative to the seat). Pivot arm 110 is thus influential to the horizontal movement of pivot point B by forces transferred by the connecting arm 118.

The connecting arm 118 has a first end pivotally coupled relative to the seat 106 and a second end pivotally coupled to the pivot arm 108. The connecting arm 118 is connected to the pivot arm 108 at a point between its connection to the base support 102 and the back-knee rest 104. The second end of the connecting arm 118 pivots about pivot point 'C' (the connecting arm pivot point) shown in the figures. The first end of the connecting arm is pivotally coupled to pivot about pivot point B. In other embodiments, it may be pivotally coupled to any suitable point fixed relative to the seat 106. In yet other embodiments, no operably coupling may be provided between the seat 106 and knee-back rest. In such an embodiment they may be moved independently of each other to convert the chair.

The coupling mechanism 110 further comprises a suspension mechanism 122 by which the seat 106 is at least partly connected to the base support 102. The suspension mechanism 122 is arranged to provide a flexible coupling between the seat and the base support 102 (and between the back-knee rest 104 and the base support via the connecting arm 118). In use this allows a degree of flexibility in the chair to aid comfort. The suspension mechanism 122 is arranged to provide a greater flexibility in the sitting configuration of the chair compared to the kneeling configuration of the chair. This allows a more appropriate level of flexibility to be provided for each configuration.

The suspension mechanism comprises a flexure member 124 that forms at least part of the connection between the seat 106 and the base support 102. In the present embodiment, the flexure member 124 forms part of the fixed slider support 112 to which the seat 106 is pivotally and translationally coupled. The flexure member 124 is, therefore, also coupled to the back-knee rest via the connecting arm 118. In the sitting configuration of the chair 100 the flexure member 124 is configured to have a first unsupported length, and in the kneeling configuration of the chair the flexure member 124 is configured to have a second relatively shorter unsupported length. The sliding coupling of the coupling mechanism is provided at a point that moves along the length of the flexure member so that its unsupported length changes between the sitting and kneeling configurations of the chair. By reducing the unsupported length, the flexibly of the part of the flexure member connecting the seat/back-knee rest and base support can be changed, therefore changing the amount the seat/back-knee rest can move by flexing of the flexure member in the two chair configurations.

The suspension mechanism 122 further comprises an adjuster 126 arranged to independently adjust the unsupported length of the flexure member 124 (e.g. independently of that caused by movement of the seat 106). The adjuster 126 comprises a movable abutment member 128 defining one end of the unsupported length of the flexure member 124. The abutment member is movably coupled to a screw thread 126*a* so that its position can be adjusted relative to the flexure member 124, thereby adjusting the unsupported length of the flexure member 124.

Referring again to FIG. 1, the base support 102 comprises a plurality of radially extending legs 130. The legs each extend orthogonally from a central base stem 132 that extends upwards to support the seat 106 and back-knee rest 104 off the ground. A first (lower) end of the base stem is connected to each of the support legs 130, with a second (upper) end of the base stem connected to the fixed slider support 112 and pivot arm 108. The base stem 132 comprises a curved portion 132*a* at or near the second end so that the second end is offset relative to the first end (e.g., they are not directly above each other). This allows space for the fixed slider support 112 beneath the seat 106. In other embodiments, any other suitable shape base stem 132 may be provided, e.g., it may be straight.

In the present embodiment, the base stem 132 comprises a height adjustment mechanism 134 in the form of a hydraulic cylinder. The height adjustment mechanism 134 allows the height of the seat 106 and knee-back rest above the ground to be adjusted by changing the length of the base stem 132. The height adjustment mechanism may be operated by a height adjustment knob 134*a* attached to the seat 106 in a conventional manner (in either configuration of the chair). In other embodiments, other forms of height adjustment may be provided, or the adjustment knob provided in any other suitable position on the chair.

The base support 102 is configured to provide rotational/swivel movement of the seat 106 and back-knee rest (e.g., about a vertical axis of the base support) while allowing the part of the base support contacting the ground to remain stationary. A swivel point may be located at a point along the length of the base stem. In the present embodiment, this is provided at the height adjustment cylinder. In other embodiments, no swivel connection may be provided.

Each of the legs 130 comprise a distal wheel portion 130*a* having a wheel 136 or caster connected thereto. Each leg 130 further comprises a connection portion 130*b* located proximally from the wheel portion 130*a* e.g., closer to the central connection to the base stem 132. The legs each comprise a cut-out portion of reduced height or thickness extending at least part way between the wheel portion and the base stem. As can be seen in the figures, the height (i.e., perpendicular distance from a plane joining the contact points of the wheels) hi of a top surface of the connection portion 130*b* from the ground is less that the height h2 of a top surface of the wheel portion 130*a* from the ground. This means that the legs 130 take up less vertical space, and provide the user with more room for their feet and legs.

Preferably the base support comprises five or fewer legs 130. In the presently described embodiment the base support comprises four radially extending legs. By having five or fewer legs the base support is smaller and gives more space for the user's feet. In other embodiments, four or fewer legs 130 may be provided to provide further space for the user's feet.

The base support 102 shown in the figures is one example only. In other embodiments, the wheels/castors 136 may not be provided. The number of legs used may vary, and may be greater than five. In other embodiments, the base support 102 may not comprise only a central vertical stem, but may comprise any suitable structure on which the seat and back-knee rest can be mounted. Both the pivot arm 108 and connecting arm 118 may consist of a plurality of arms situated astride the base stem and parallel to one another will be described in connection with FIGS. 6 and 7. Alternatively, the pivot arm and connecting arm 118 may be connected to one side of the base stem 132 e.g. predominantly underneath either the left or right hand side of the user when sat in the chair.

Each of the back-knee rest 104 and seat 106 comprise a soft pad mounted to a backing structure for supporting the user's weight in each configuration of the chair in a conventional manner. The chair further comprises arm rests 138 that are positioned either side of the seat 106. The arm rests may be coupled to the seat 106 (e.g., to the underside of the seat 106), or below the seat to part of the coupling mechanism 110. The coupling arm 108 is pivotally connected to the side of the base stem 132.

In some embodiments (not shown in the figures) the chair may comprise a damping system arranged to control movement between the sitting and kneeling configurations. The damping system may comprise a damper arranged to control sliding movement of the coupling mechanism. The damper may comprise an air sprung cylinder to slow/control movement. The damper may be connected between a point on the seat or component rigidly connected to it, and a point on the base support 102.

The chair further comprises a locking mechanism that is actuated by locking control 140 (illustrated only schematically in FIG. 1). The locking mechanism has a locked configuration in which the coupling mechanism is fixed (and therefore the back-knee rest where they are operably coupled) to prevent movement between the sitting and kneeling configurations of the chair. The locking mechanism may comprise a sprung catch mechanism acting between suitable parts of the coupling mechanism to keep it locked in either the sitting or kneeling configuration of the chair. The locking mechanism is provided to secure the chair in the sitting configuration in addition to the releasable catch 111, and therefore can be referred to as a secondary locking mechanism, and as such should therefore be understood as being optional.

Figure 4:
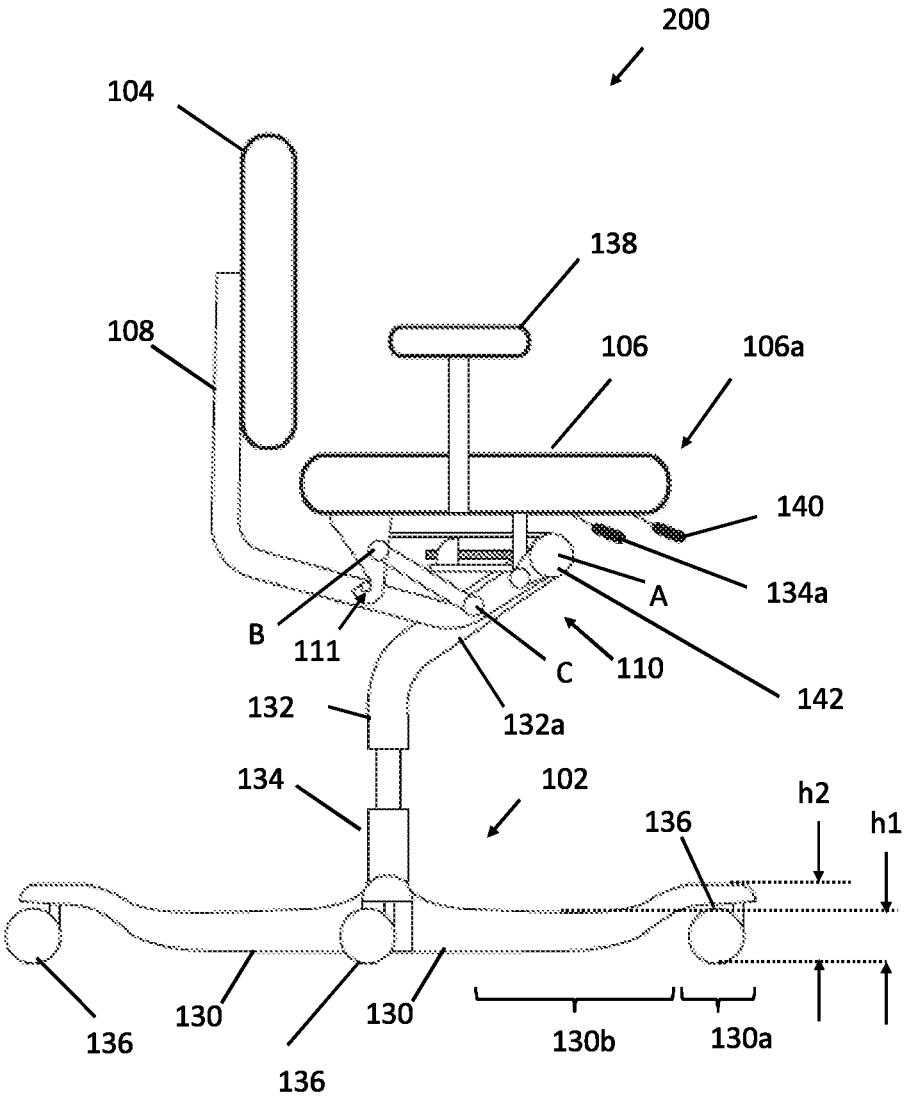
FIG. 4 is a side elevational view of a second embodiment of the chair shown in FIG. 1 in conventional upright seated configuration.
Figure 5:
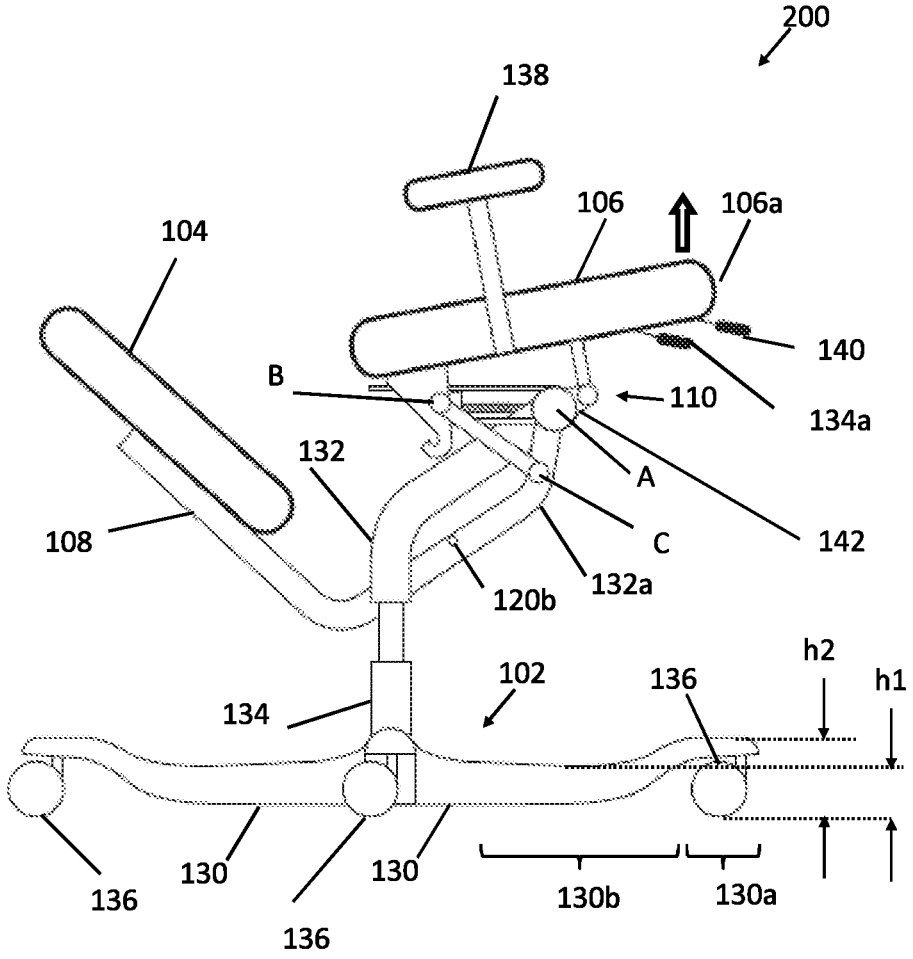
FIG. 5 is a side elevational view of the second embodiment in kneeling configuration.

Another embodiment of the chair 200 is shown in FIGS. 4 and 5. The same reference numbers have been used for corresponding components to aid explanation. In this embodiment the control mechanism is formed by a cam mechanism (which may be referred to as a crank mechanism) comprising a cam (or crank) member 142 connected between the seat 106 and the base support, wherein the cam member is arranged to control rotational and translational movement of the seat 106 between the first and second seat positions. The cam member 142 may replace the guide member 114 of the embodiment shown in FIGS. 1, 2 and 3 and similarly acts to control the motion of the seat 106 relative to the base support 102. The cam member 142 is pivotally connected to the base support at a first end, and pivotally coupled relative to the seat at a second end. The pivotal connection to the base support 102 may be provided at pivot point A as shown in the figures. The cam mechanism may thus be arranged to maneuver the seat between its first and second positions.

FIGS. 6 and 7 illustrate an embodiment of the chair 100 similar to that of FIGS. 1, 2 and 3. Corresponding reference numbers have therefore been used. FIGS. 6 and 7 illustrate further detail of the pivot arm and coupling mechanism described above. Any of the features described in association with FIGS. 6 and 7 may be used in combination with any other embodiment herein.

Referring to FIG. 6, a top view of the chair 100 is illustrated. The knee-back rest 104 and seat 106 are shown in broken lines so that other components of the chair are visible. FIG. 7 shows a corresponding close-up perspective view.

In the embodiment shown in FIGS. 6 and 7, the pivot arm 108 comprises first and second sections 108*a*, 108*b*, each extending between a point of connection with the knee-back rest and a pivotal coupling to the base support 102 at pivot point A as discussed above. The first and second sections of the pivot arm 108 are connected at the knee-back rest 104 to provide structural strength. The first and second sections of the pivot arm 108 are disposed on opposite sides of the base stem 132, and each pivotally connected to the base stem 132 by a shaft 108*c*. Each of the first and second sections 108*a*, 108*b* of the pivot arm 108 are pivotally connected to a respective first and second connecting arm 118*a*, 118*b*. The connecting arms 118*a*, 118*b* are each connected to the respective section of the pivot arm 108 via a connecting pin 118*c* (one of which can be seen in FIG. 7) about which they may pivot in order to form pivot points corresponding to pivot point C already described.

In the embodiment shown in FIGS. 6 and 7 the coupling mechanism 110 comprises first and second guide members 114*a*, 114*b* in which respective guide tracks 115 are formed (only one of the guide tracks is visible in FIG. 7, and is shown in broken lines). Each guide member 114*a*, 114*b* is formed by a plate extending from the underside of the seat 106. The coupling mechanism 110 further comprises a shaft 144 that forms pivot point B at which the seat 106 is pivotally coupled to the base support 102. The shaft. 144 is fixed relative to the seat 106 and is pivotally and slidably connected to the base support 102 via the flexure member 124 as described in connection with FIGS. 1 and 2. In the embodiment shown in FIGS. 6 and 7, the shaft 144 is mounted to the plate forming the guide members 114*a*, 114*b* as can be seen in FIG. 7.

The coupling mechanism further comprises a plate 146 extending from the underside of the seat 106 that forms part of the releasable catch 111. The plate 146 forms the booked member 120*a* which is arranged to releasably engage with a pin 120*b* provided on the second section 108*b* of the pivot arm 108*a*. In the present embodiment, the releasable catch 111 couples only to the second section of the pivot arm 108. In other embodiments, the releasable catch 111 may instead connect to the first section of the pivot arm, or may comprise two plates extending from the seat 106 forming first and second hooked members, each arranged to releasbly connect to a first pin on the first section of the pivot arm and a second pin on the second section of the pivot arm 108.

The shaft 144 further provides a point of connection for the first and second connecting arms 118*a*, 118*b*. As can be seen in FIG. 7, each of the first and second connecting arms 118*a*, 118*b* are pivotally connected, at an end opposite the connection to the pivot arm 108, to the shaft 144. They are therefore pivotally connected to a point that is fixed relative to the seat 106. In other embodiments, they may be pivotally connected to a different point on the seat 106 that is separate from pivot point B about which the seat pivots with respect to the base support.

In the embodiment of FIGS. 1 and 4 the locking control 140 that engages and disengages the secondary locking mechanism may be provided in a number of different ways. For example, a cable that may be pulled to release a latch restraining pin 116*a* in a fixed position within the track 115 may be used. In yet other embodiments, the secondary locking mechanism may lock other parts of the coupling mechanism together other than the pin 116*a* and guide track. This also applies to the embodiments of FIGS. 6 and 7.

In use, the chair may be used in a convention manner in the sitting configuration shown in FIG. 1. When seated in the standard seating configuration and wishing to convert the chair to its alternative kneeling configuration, the user may stand, and actuate the conversion by means of lifting the seat 106 and/or pushing the knee-backrest to move them between the respective first and second positions. Before doing this, the user may operate the secondary locking mechanism by using locking control 140. The seat 106 and knee-back rest may be swivelled 180 degrees relative to the legs 130 so that the user can kneel facing in the same direction in which they were sitting. Alternatively, the user may rotate the entire chair through 180 degrees if the base support has no swivel connection. The swivel/rotation of the chair may be done before or after actuating the movement of the seat and knee-back rest. The user may then take the new seated-kneeling position on the chair. In order to reverse the process and convert the kneeler chair back into a standard seating position chair, the user may stand and actuate the conversion by means of lifting the knee-backrest 104 and rotating the seat or chair back to its original orientation.

Where the seat 106 and knee-backrest are not operatively coupled, they may be actuated separately by the user so that they are each moved separately between their first and second positions.

In more detail, to convert the chair 100 from the sitting configuration to the sit-kneel configuration the user actuates downward rotation of back-knee rest 104 and pivot arm 108 by lifting the front edge 106*a* of seat 106 to disengage the releasable catch 111. This results in the seat 106 pivoting around pivot point B. Pivot point A (pin 116) follows the path of the arcuate portion 115*a* of the guide track 115. This simultaneously releases safety hook pin 120*b* from safety hook 120*a* so that releasable catch 111 is released and the pivot arm 108 can move relative to the base support 102. Connecting arm 108 pivots so that the back-knee rests moves downwards and horizontally towards base support 102 to move the back-knee rest between its first and second positions. This in turn influences pivot point B, forcing it to roll/slide along the fixed slider support (e.g., along the flexure member where it is provided) via force transmitted by the connecting arm 118. During this sliding motion pivot point A follows the linear portion 115*b* of the guide track 115 until the pin 116 abuts the end of the guide track 115. The angle and repositioning of the seat 106 and knee-back rest 104 in the sit-kneel configuration are thus held in a rigid fashion due to guide track having restricted the motion of the connecting arm 108. A similar function is achieved using the cam arrangement of the embodiment of FIGS. 4 and 5. The seat and knee-back rest are then in their new fixed positions allowing the user to sit-kneel on the chair. It can thus be seen that connection points at pivot points A, B, and C form the three main structural support intersections of the chair.

To convert the chair from the sit-kneel configuration to the upright seated configuration, the user lifts the knee-backrest 104 such that pivot arm 108 pivots about pivot point A, so that the knee-back rest 106 is in a more generally vertical position above the seat 104. Due to the connecting forces exerted by connecting arm 118 the seat 106 slides back along the fixed slider support 112 in a linear fashion and then rotates around pivot point B. The motion of the seat 106 is again controlled by motion of the pin 116 in the linear 115*b* and arcuate 115*a* portions of the guide track 115. This repositions the seat to the upright standard seating position and the user's centre of gravity when seated more over centre of the base support (e.g., over the connection of the base stem to the legs). The pivoting motion of the seat brings safety hook pin 120*b* and safety hook 120*a* back into engagement so that the releasable catch 111 is engaged, locking the seat 106 and pivot arm 108 into the new position and enabling the chair to stay safely in an upright position until a conversion to sit-kneel configuration is desired by user.

While the embodiments of the convertible chair described herein have both a releasable catch and combined rotational-translational movement of the seat relative to the base support these features may not be provided together. In other embodiments therefore, one or both of these features may be absent.

Various modifications will be apparent to the skilled person without departing form the scope of the claims. In the light of this disclosure modifications and equivalents of the described embodiment as well as other embodiments within the scope of the appended claims will now become apparent to a person skilled in the art. The embodiments described above should be understood as exemplary only. Any feature of any of the aspects or embodiments of the disclosure may be employed separately or in combination with any other feature of the same or different aspect or embodiment of the disclosure and the disclosure includes any feature or combination of features disclosed herein.

The following clauses (which are not claims) may define another aspect of the present application:

Clause 1. A convertible chair adapted for conversion between a sitting configuration and a kneeling configuration, the chair comprising:

a base support;

a knee-back rest movably coupled to the base support by a pivot arm, the pivot arm arranged to pivot relative to the base support between a first pivot arm position in which the knee-back rest is in a first knee-back rest position corresponding to the sitting configuration in which the knee-back rest is positioned for use as a back rest and a second pivot arm position in which the knee-back rest is in a second knee-back rest position corresponding to the kneeling configuration in which the knee-back rest is positioned for use as a knee rest; and a seat movably coupled to the base support by a coupling mechanism, whereby the seat is arranged to move relative to the base support between a first seat position corresponding to the sitting configuration and a second seat position corresponding to the kneeling configuration, wherein:

the coupling mechanism comprises a releasable catch arranged to couple the pivot arm and the seat when in the first seat position and the first pivot arm position, thereby restricting pivotal movement of the pivot arm relative to the base support, and the releasable catch is arranged to release by pivotal movement of the seat away from the first seat position.

Clause 2. A convertible chair according to Clause 1, wherein the releasable catch is arranged to release by pivotal movement of the seat away from the first seat position in which an edge of the seat furthest from the knee-back rest moves in a vertical direction of the chair.

Clause 3. A convertible chair according to Clause 2, wherein:

the edge of the seat furthest from the knee-back rest is a front edge of the seat; the seat further comprises a back edge opposite the front edge, the back edge being relatively closer to the knee-back rest when the chair is in the sitting configuration; the seat is arranged to pivot relative to the base support at a seat pivot point; and the seat pivot point is located closer to the back edge of the seat compared to the front edge when the seat is in the first seat position and the chair in the sitting configuration.

Clause 4. A convertible chair according to any preceding Clause, wherein the releasable catch comprises a hooked member coupled to one of the seat and the pivot arm, the hooked member arranged to releasably engage with a pin provided on the other of the seat and the pivot arm.

Clause 5. A convertible chair according to any preceding Clause, wherein the seat is arranged to translate and pivot relative to the base support between the first seat position and the second set position.

Clause 6. A convertible chair according to Clause 5, wherein the seat is arranged to translate in a direction away from the location of the knee-back rest in the knee-back rest first position when the seat moves from the first seat position to the second seat position.

Clause 7. A convertible chair according to Clause 5 or Clause 6, wherein the coupling mechanism comprises a guide track connected to one of the seat or the base support and a guide pin connected to the other of the seat and the base support. wherein the guide pin is received in the guide track to control movement of the seat between the first and second seat positions.

Clause 8. A convertible chair according to Clause 7, wherein the guide track comprises an arcuate portion arranged to guide rotational movement of the seat and a linear portion arranged to guide translational movement of the seat.

Clause 9. A convertible chair according to any of Clauses 5 to 8, wherein the coupling mechanism comprises a cam mechanism having a cam member connected between the seat and the base support, wherein the cam member is arranged to control rotational and translational movement of the seat between the first and second seat positions.

Clause 10. A convertible chair according to any preceding Clause, wherein the coupling mechanism is operably coupled to the pivot arm, whereby movement of the seat or knee-back rest between the respective first and second positions causes movement of the other of the seat or knee-back rest between the respective first and second positions.

Clause 11. A convertible chair according to Clause 10, wherein the operable coupling is provided by a connecting arm having a first end pivotally coupled relative to the seat and a second end pivotally coupled to the pivot arm, preferably at a point between the base support and the back-knee rest.

Clause 12. A convertible chair according to any preceding Clause, further comprising a suspension mechanism arranged to provide a flexible coupling between the seat and/or the knee-back rest and the base support, wherein the suspension mechanism is arranged to have a greater degree of flexibility in the sitting configuration of the chair compared to the kneeling configuration of the chair.

Clause 13. A convertible chair according to Clause 12, when also dependent directly or indirectly on Clause 4, wherein the suspension mechanism comprises a flexure member that forms at least part of the connection between the seat and the base support, and/or the knee-back rest and the base support, wherein a sliding coupling of the coupling mechanism is arranged to change an unsupported length of the flexure member between the sitting and kneeling configurations of the chair thereby changing the degree of flexibility of the suspension mechanism.

Clause 14. A convertible chair according to Clause 12 or Clause 13, wherein the coupling mechanism further comprises an adjuster arranged to independently adjust the unsupported length of the suspension member.

Clause 15. A convertible chair according to any preceding Clause, wherein the base support comprises a plurality of radially extending legs.

Clause 16. A convertible chair according to Clause 15, wherein at least one of the legs comprises a distal wheel portion having a wheel or caster connected thereto on which the chair is arranged to rest on the ground or other surface, and a proximally located connection portion, wherein the height of a top surface of the connection portion from the ground or other surface is less that the height of a top surface of the wheel portion from the ground or other surface to form a cut-out region of the respective leg.

Clause 17. A convertible chair according to Clause 15 or Clause 16, wherein the plurality of legs comprises five or fewer legs.

Clause 18. A convertible chair according to any preceding Clause, further comprising a damping system arranged to control movement between the sitting and kneeling configurations.

Clause 19. A convertible chair according to Clause 18, wherein the damping system comprises a damper arranged to control sliding movement of the coupling mechanism.

Clause 20. A convertible chair according to any preceding Clause, further comprising a locking mechanism, the locking mechanism having a locked configuration in which the coupling mechanism is locked to prevent movement between the sitting and kneeling configurations of the chair.

Clause 21. A convertible chair according to any preceding Clause, wherein the base support comprises a vertically extending base stem, wherein the pivot arm is pivotally connected to an upper region of the base stem.

Clause 22. A convertible chair according to any preceding Clause, further comprising one or more arm rests coupled to the seat or the coupling mechanism.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A convertible chair adapted for conversion between a sitting configuration and a kneeling configuration, the chair comprising:

a base support;

a knee-back rest movably coupled to the base support by a pivot arm, the pivot arm arranged to pivot relative to the base support between a first pivot arm position in which the knee-back rest is in a first knee-back rest position corresponding to the sitting configuration in which the knee-back rest is positioned for use as a back rest and a second pivot arm position in which the knee-back rest is in a second knee-back rest position corresponding to the kneeling configuration in which the knee-back rest is positioned for use as a knee rest;

a seat movably coupled to the base support by a coupling mechanism, whereby the seat is arranged to move relative to the base support between a first seat position corresponding to the sitting configuration and a second seat position corresponding to the kneeling configuration; and a connecting arm linking the pivot arm and the seat, the connecting arm having a first end pivotally coupled relative to the seat and a second end pivotally coupled to the pivot arm whereby the seat and the knee-back rest are operably linked to each other, wherein the second end of the connecting arm is pivotally coupled to the pivot arm at a point between the base support and the back-knee rest, wherein:

the coupling mechanism comprises a releasable catch arranged to couple the pivot arm and the seat when in the first seat position and the first pivot arm position, thereby restricting pivotal movement of the pivot arm relative to the base support, the releasable catch arranged to release by pivotal movement of the seat away from the first seat position; and the coupling mechanism further comprises a control mechanism arranged to control and restrict the range of movement of the seat relative to the base support between the first seat position and the second seat position when the releasable catch is released, wherein the seat is arranged to translate and pivot relative to the base support between the first seat position and the second seat position.

2. The convertible chair according to claim 1, wherein the seat is arranged to translate in a direction away from the location of the knee-back rest in the knee-back rest first position when the seat moves from the first seat position to the second seat position.

3. The convertible chair according to claim 1, wherein the control mechanism comprises a guide track connected to one of the seat or the base support and a guide pin connected to the other of the seat and the base support, wherein the guide pin is received in the guide track to control movement of the seat between the first and second seat positions.

4. The convertible chair according to claim 3, wherein the guide track comprises an arcuate portion arranged to guide rotational movement of the seat and a linear portion arranged to guide translational movement of the seat.

5. The convertible chair according to claim 1, wherein the control mechanism comprises a cam mechanism having a cam member connected between the seat and the base support.

6. The convertible chair according to claim 5, wherein the cam member is arranged to control rotational and translational movement of the seat between the first and second seat positions.

7. The convertible chair according to claim 1, further comprising a suspension mechanism arranged to provide a flexible coupling between the seat or the knee-back rest and the base support, wherein the suspension mechanism is arranged to have a greater degree of flexibility in the sitting configuration of the chair compared to the kneeling configuration of the chair.

8. The convertible chair according to claim 7, wherein the suspension mechanism comprises a flexure member that forms at least part of the connection between the seat and the base support or the knee-back rest and the base support, wherein a sliding coupling of the coupling mechanism is arranged to change an unsupported length of the flexure member between the sitting and kneeling configurations of the chair thereby changing the degree of flexibility of the suspension mechanism.

9. The convertible chair according to claim 7, wherein the coupling mechanism further comprises an adjuster arranged to independently adjust the unsupported length of the suspension member.

10. The convertible chair according to claim 1, wherein the base support comprises a plurality of radially extending legs.

11. The convertible chair according to claim 10, wherein at least one of the legs comprises a distal wheel portion having a wheel or caster connected thereto on which the chair is arranged to rest on the ground or other surface, and a proximally located connection portion.

12. The convertible chair according to claim 11, wherein the height of a top surface of the connection portion from the ground or other surface is less than the height of a top surface of the wheel portion from the ground or other surface to form a cut-out region of the respective leg.

13. The convertible chair according to claim 10, wherein the plurality of legs comprises four legs.

14. The convertible chair according to claim 1, further comprising a locking mechanism, the locking mechanism having a locked configuration in which the coupling mechanism is locked to prevent movement between the sitting and kneeling configurations of the chair.

15. The convertible chair according to claim 1, wherein the base support comprises a vertically extending base stem, wherein the pivot arm is pivotally connected to an upper region of the base stem.

16. The convertible chair according to claim 1, further comprising one or more arm rests coupled to the seat or the coupling mechanism.

* * * * *